US006593579B2

(12) United States Patent
Whithman

(10) Patent No.: US 6,593,579 B2
(45) Date of Patent: Jul. 15, 2003

(54) RF MODULATED ELECTRON GUN

(75) Inventor: Kenneth Whithman, Alamo, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 153 days.

(21) Appl. No.: 09/866,418

(22) Filed: May 25, 2001

(65) Prior Publication Data

US 2002/0175293 A1 Nov. 28, 2002

(51) Int. Cl.[7] ..... H03F 3/58

(52) U.S. Cl. ..... 250/423 F; 315/111.81; 313/348; 330/44

(58) Field of Search ..... 250/423 F, 427; 315/5.34, 5.37, 5.42, 111.81; 313/348, 350; 330/44, 53, 56

(56) References Cited

U.S. PATENT DOCUMENTS 3,798,563 A * 3/1974 Carter et al. ..... 330/44

* cited by examiner

*Primary Examiner*—Kiet T. Nguyen

(57) ABSTRACT

A radio frequency (RF) modulated electron gun includes a cathode, electrically coupled to operate as a source of charged particles, and a grid, positioned apart from the cathode. The grid and the cathode are electrically coupled to a grid voltage source and to a RF source. The grid voltage source places the grid at a first potential, and the RF source places the grid at a second potential selected to produce groups of the charged particles. The groups of charged particles are produced with each period of a signal received from the RF source.

22 Claims, 3 Drawing Sheets

RF MODULATED ELECTRON GUN

BACKGROUND OF THE INVENTION

1. Field of the Invention

The present invention relates generally to the generation of focused electron beams and more particularly, to a radio frequency (RF) modulated electron gun.

2. Description of the Related Art

Electron guns have been used for decades to provide a source of electrons for devices such as linear accelerators. For example, electron guns can be used as a source of charged particles for linear accelerators used in medical radiation treatment, radiation processing of materials and other applications such as basic or applied research. For many applications, the electron gun is used to generate charged particles for input to a RF accelerator waveguide. The accelerator waveguide receives the input charged particles and accelerates them to produce an accelerated output beam of a desired frequency for use in a particular application.

Frequently, the beams generated by the electron gun are passed through one or more devices referred to as "pre-bunchers" which may be formed as separate chambers positioned between the electron gun and an accelerator waveguide, or may be formed as a separate input cavity of the waveguide. These devices are used to group charged particles from the electron gun into "bunches" or "macropulses" of charged particles. Typically, each macropulse has a pulse duration equal to the full width of the beam pulse to be injected into the RF accelerator waveguide. Once injected into the waveguide, the macropulse of electrons is then modulated by the RF input into the waveguide to create a series of micropulses at the RF frequency. As an example, in a typical medical linear accelerator, a macropulse is approximately 5 $\mu$S long. Typical micropulses generated from these 5 $\mu$S pulses are approximately 30 pS long (that is, there are many thousand micropulses created from each micropulse input into the linear accelerator).

This process of pre-bunching makes it possible to improve the efficiency of a linear accelerator. However, it can be difficult and costly to produce an efficient and well-tuned pre-buncher or input cavity of a waveguide. In particular, the amount of current generated by a cathode of a typical electron gun must be very large because much of the gun current is lost between the electron gun and the linear accelerator. Due to inefficiencies in pre-bunchers or input cavities, much of the gun current is stopped or reversed by the accelerator RF and returned to the gun. This current which is stopped or returned to the gun increases heat at the cathode. Unless the effect of this returned current is properly factored into the cathode heat system design, the increased heat will reduce the life of the cathode and also increase barium evaporation at the cathode which can result in the generation of increased dark current.

Further, the use of a pre-buncher or input cavity requires the manufacture, assembly, and design of an additional cavity or structure at the input end of the accelerator. This can increase the cost of design and manufacture and further complicates the tuning, focusing and control of these complex devices.

It would be desirable to provide an electron gun which is operable to produce bunches of charged particles at a desired frequency without the use of a separate pre-buncher or input RF cavity. It would further be desirable to provide an electron gun for which the frequency and amount of the bunches of charged particles can be varied based on the needs of a particular application. Preferably, such a device could be used with existing accelerators without substantial modification to the accelerator tube.

SUMMARY OF THE INVENTION

To alleviate the problems inherent in the prior art, embodiments of the present invention provide an improved electron gun which produces bunches of charged particles at a desired frequency without use of a separate pre-buncher or input RF cavity. The present invention is not limited to the disclosed preferred embodiments, however, as those skilled in the art can readily adapt the teachings of the present invention to create other embodiments and applications.

According to one embodiment of the present invention, an electron gun includes a cathode, electrically coupled to operate as a source of charged particles, and a grid, positioned apart from the cathode. The grid and the cathode are electrically coupled to a grid voltage source and to a radio frequency (RF) source. The grid voltage source places the grid at a first potential, and the radio frequency source places the grid at a second potential selected to produce groups of the charged particles. The groups of charged particles are produced with each period of a signal received from the RF source.

According to one embodiment, the RF source is adapted to receive a signal from a primary RF source. The primary RF source provides an RF signal to an accelerator and to the RF source. According to one embodiment, the RF signal is attenuated and/or phase shifted before it is provided to the grid of the electron gun. According to one embodiment of the invention, the duration of the bunches of electrons is selected by variably attenuating the signal.

In a further embodiment of the present invention, a method for generating an electron beam is provided where a first RF signal is generated for input into a linear accelerator. A modified RF signal is generated. Electrons are caused to be emitted from an emitting surface of a cathode. A D.C. bias is applied to the cathode and to a conductive grid, the conductive grid positioned apart from the emitting surface of the cathode. The modified RF signal is applied to the cathode and to the conductive grid, where the modified RF signal is selected to accelerate groups of the electrons, each of the groups having a duration. The groups of electrons are accelerated into the linear accelerator by applying an anode bias to an anode positioned apart from the cathode.

BRIEF DESCRIPTION OF THE DRAWINGS

The exact nature of this invention, as well as its objects and advantages, will become readily apparent from consideration of the following specification as illustrated in the accompanying drawings, in which like reference numerals designate like parts throughout the figures thereof, and wherein.

DETAILED DESCRIPTION

The following description is provided to enable any person skilled in the art to make and use the invention and sets forth the best modes contemplated by the inventor for carrying out the invention. Various modifications, however, will remain readily apparent to those skilled in the art.

Figure 1:
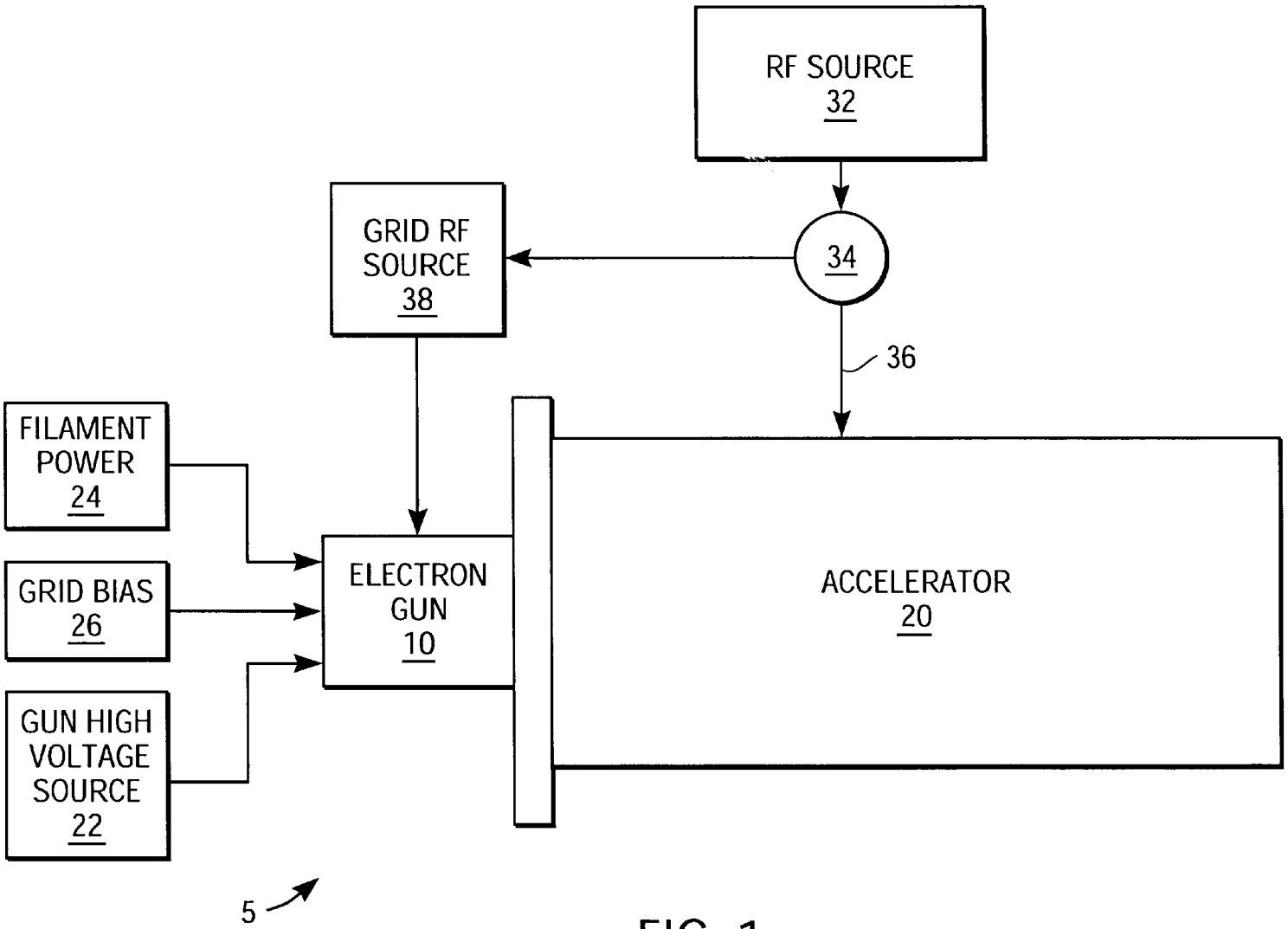
FIG. 1 is block diagram depicting an electron gun and linear accelerator configured according to embodiments of the present invention.

Features of embodiments of the present invention will now be described by first referring to FIG. 1, where a block diagram depicting a linear accelerator system 5 incorporating an electron gun 10 according to an embodiment of the present invention is shown. Linear accelerator system 5 may be a linear accelerator used in, for example, a medical radiation treatment device or other device used in applications requiring the delivery of high frequency charged particles.

Linear accelerator system 5 includes an electron gun 10 and an accelerator 20. Unlike previous linear accelerator systems, however, system 5 utilizes an electron gun 10 without a separate pre-bunching device or a separate input cavity of accelerator 20. According to one embodiment of the invention, electron gun 10 delivers bunched charged particles directly to accelerator 20 without need for a separate pre-bunching device or cavity, reducing the cost and complexity of system 5.

According to the invention, linear accelerator system 5 includes several different power sources which are used to assist in the generation of a source of electrons and to bunch an accelerate the electrons into accelerator 20. A gun high voltage source 22 is utilized to bias elements of the gun including a cathode and an anode. A grid bias 26 is used to bias a grid with respect to a cathode of the gun, and a filament power supply 24 is used to heat a cathode in the gun. These sources and components will be described further below in conjunction with FIG. 2.

Further, according to the invention, electron gun 10 is provided with input RF signals from a RF source 32 via a grid RF device 38. RF source 32 is a device producing high frequency microwave energy (e.g., kilowatts of power at 2–3 GHz). For example, RF source 32 may be a klystron amplifier coupled to deliver a high frequency signal to accelerator 20, e.g., via a waveguide 36. Those skilled in the art, upon reading this disclosure, will recognize that any RF source 32 suitable for use with linear accelerators may be utilized with embodiments of the present invention.

According to one embodiment of the present invention, a directional coupler 34 or other device is used to split or direct the RF signal from RF source 32 to both the accelerator 20 and to grid RF device 38. Grid RF device 38 provides a modified RF signal to a grid located within electron gun 10. As will be described further below, the RF signal provided to the grid within electron gun 10 from grid RF device 38 is attenuated and shifted in phase to ensure that bunches of electrons produced within electron gun 10 appropriately generated and in-phase with the RF provided to accelerator 20. Each of these components and their interaction to produce an improved device will be described in further detail below with reference to FIG. 2.

Figure 2:
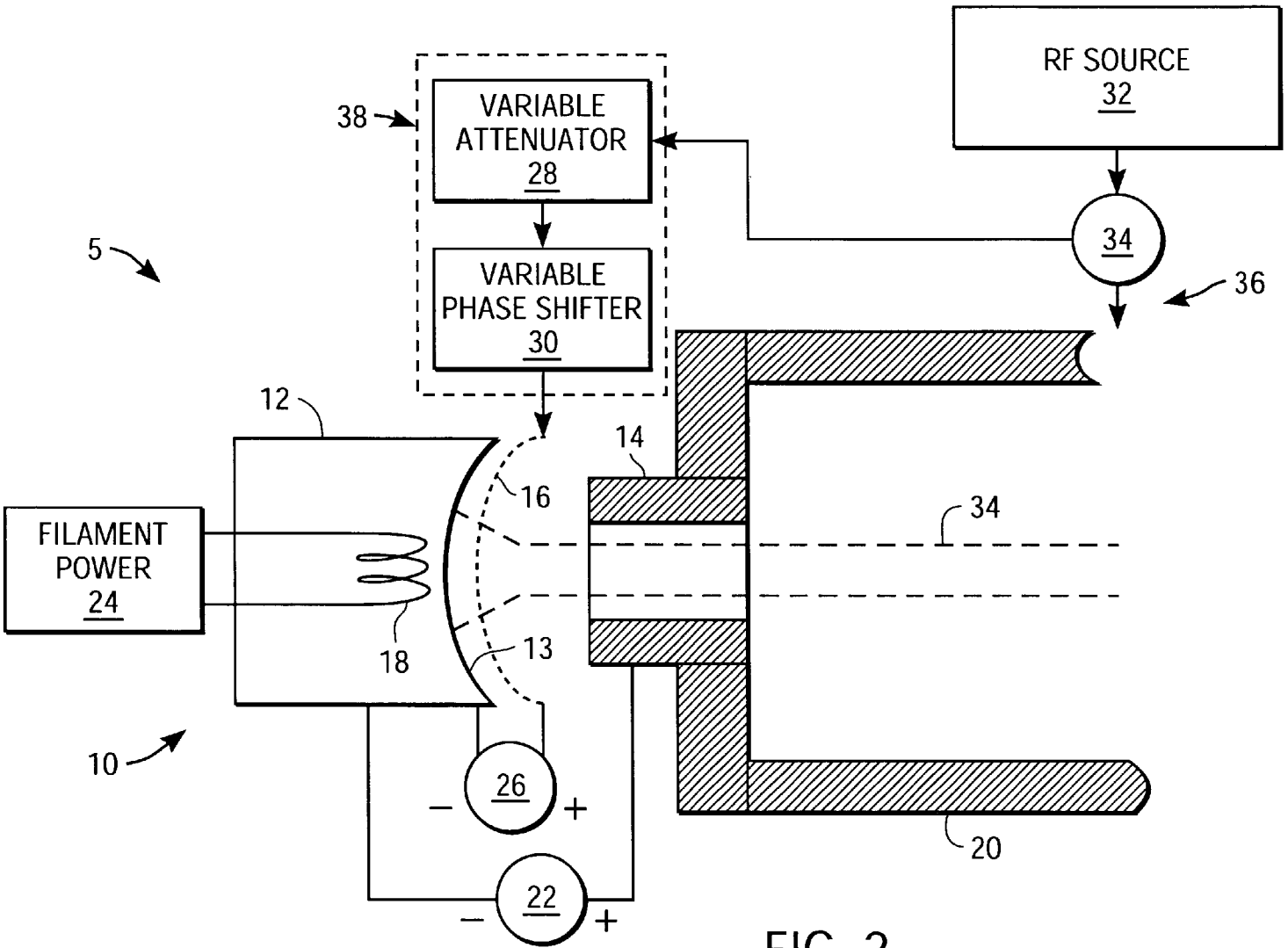
FIG. 2 is a detailed block diagram depicting components of the electron gun of FIG. 1.

In the embodiment depicted in FIG. 2, electron gun 10 includes a cathode 12 positioned apart from an anode 14. A grid 16 is positioned near an emitting surface of cathode 12. Grid 16 and cathode 12 are placed at different potentials by grid bias 26, causing electrons emitted from a surface 13 of cathode 12 to accelerate through grid 16. Cathode 12 and anode 14 are placed at different potentials by gun high voltage source 22. In one embodiment, anode 14 is placed at or near ground while cathode 12 is placed substantially below ground (e.g., at a potential difference of approximately 15 kV).

Cathode 12 is directly or indirectly heated by one or more filaments 18 powered by a filament power supply 24. This heating of cathode 12 causes the emission of electrons from surface 13 of cathode 12. In general, as surface 13 of cathode 12 increases in temperature, the number of electrons emitted increases. In one embodiment, filament power supply 24 and filaments 18 are operated to heat cathode 12 to a temperature of approximately 800–1500° C., depending on the application.

Cathode 12 is, in one currently-preferred embodiment, a conical cathode of the thermionic emission type known to those skilled in the art. As will be described further below, cathode 12 is preferably selected with a small grid to cathode capacitance. Therefore, a cathode 12 with a relatively small emission area (e.g., an area of approximately 0.20 to 0.75 $cm^2$) is preferably selected to achieve a small grid to cathode capacitance.

Grid 16 is formed to control the electron beam current from cathode 12. The use of grid 16 permits the beam current to be controlled with a smaller voltage (supplied by grid bias 26) than the cathode-to-anode voltage generated by gun high voltage source 22. This results in a reduction in the size and the weight of the modulator for the gun. For example, in one embodiment, the cathode-to-anode voltage generated by gun high voltage 22 is approximately 15 kVolts, and may vary from approximately 5 kV to 20 kV, depending on the application. In contrast, in one particular embodiment, the grid-to-cathode voltage generated by grid bias 26 is variable between approximately −100V and +0V, and may otherwise vary depending on the application. In one embodiment, the grid bias 26 is selected in conjunction with the magnitude of the signal provided by grid RF source 38.

Grid 16 may be any of a variety of different types of grids commonly used with electron guns. For example, although only a single grid 16 is shown, embodiments of the invention may be used with so-called "shadow" grids in addition to the primary control grid. Other types of grid structures may also be used, as will be recognized by those skilled in the art.

Electrons emitted from cathode 12 are accelerated through grid 16 and are attracted towards anode 14 as a result of this potential difference. Anode 14 has an aperture through which a focused beam 34 of accelerated electrons may pass. This focused beam of electrons 34 passes through the aperture of anode 14 into accelerator 20. In one embodiment, one or more focusing electrodes (not shown) are positioned within gun 10 to direct accelerated electrons towards anode 14 and through the aperture of anode 14 into accelerator 20. The use and selection of these focusing electrodes is generally known to those skilled in the art.

Anode 14 may be any of a variety of different types of anodes commonly used with electron guns. Preferably, anode 14 is selected to generate a focused beam 34 of desired shape and concentration for delivery into accelerator 20. Those skilled in the art will recognize that the shape and placement of the aperture of anode 14 has a direct effect on the shape and concentration of focused beam 34 and that a variety of different shapes of anode may be used, depending on the desired beam shape and concentration.

According to the invention, RF power from RF source 32 is provided to both grid RF device 38 and to accelerator 20 by way of a directional coupler 34 or other device. In particular, grid RF device 38 is coupled to provide RF signals to cathode 12 and grid 16. This connection may be made, for example, using an appropriately-sized coaxial transmission line coupled between grid RF device 38 and cathode 12 and grid 16. In one embodiment, grid RF device 38 includes a variable attenuator 28 and a variable phase shifter 30.

Many RF sources used in conjunction with linear accelerators deliver very high RF power. For many applications, this high RF power may need to be attenuated to a lower power amount. An example will be discussed further below. Use of variable attenuator 28 will allow the selective attenuation from RF source 32 as needed for a given application. Any of a number of variable attenuators which are sized to handle the RF power provided by RF source 32 may be used.

The RF signal provided by grid RF device 38 to electron gun 10 is, in some applications, phase shifted using variable phase shifter 30. Variable phase shifter 30 is used to adjust the phase of the signal provided to electron gun 10 relative to the phase of the signal provided to accelerator 20. This makes it possible to modulate the electron current generated by electron gun 10 at the same frequency as the signal used to accelerate electrons in accelerator 20. Use of a variable phase shifter 30 allows tuning as needed for a given application and configuration. Any of a number of variable phase shifters known to those skilled in the art which are sized to handle the RF power provided by RF source 32 may be used.

According to one embodiment, grid 16 and cathode 12 are electrically connected and sized to have a small capacitance (e.g., between 5–15 pF). The connection from grid RF device 38 to grid 16 and cathode 12 is preferably selected to be impedance matched at the RF frequency. The provided RF signal (appropriately attenuated and phase shifted) is thus introduced to cathode 12 and grid 16 so as to modulate them at the RF frequency.

According to the invention, the attenuated and phase shifted RF signal from RF source 32 is provided to cathode 12 and grid 16 of gun 10. This signal, in conjunction with the grid bias 26, results in the generation of "bunches" of electrons which are attracted to anode 14. The magnitude of these electron bunches can be adjusted by modifying the magnitude of grid bias 26 and/or the magnitude of the attenuated and phase shifted RF signal. Further, the phase of these electron bunches can be modified by adjusting phase shifter 30 to ensure that electronic current produced by electron gun 10 is in phase with the RF accelerating signal provided to accelerator 20 via waveguide 36.

For example, for a sample device, the grid/cathode capacitance is 8 pF, and the RF signal has a frequency of 2.998 GHz. The input impedance at this frequency is approximately 66 Ohms. In this example device, the grid cutoff voltage (the voltage where the grid no longer accelerates electrons through the grid towards the anode) is −30V, while the gun is fully turned on with a grid voltage of +70V. This example device would require a 100V positive swing on the RF signal received from RF source 32 to place the gun in a fully turned on state from an off state. The required RF power which must be provided to grid 16 from variable attenuator 28 is therefore approximately 150 Watts (i.e., $(100V)^2/66$ Ohms). An illustration of this example is shown in FIGS. 3 and 4.

Figure 3:
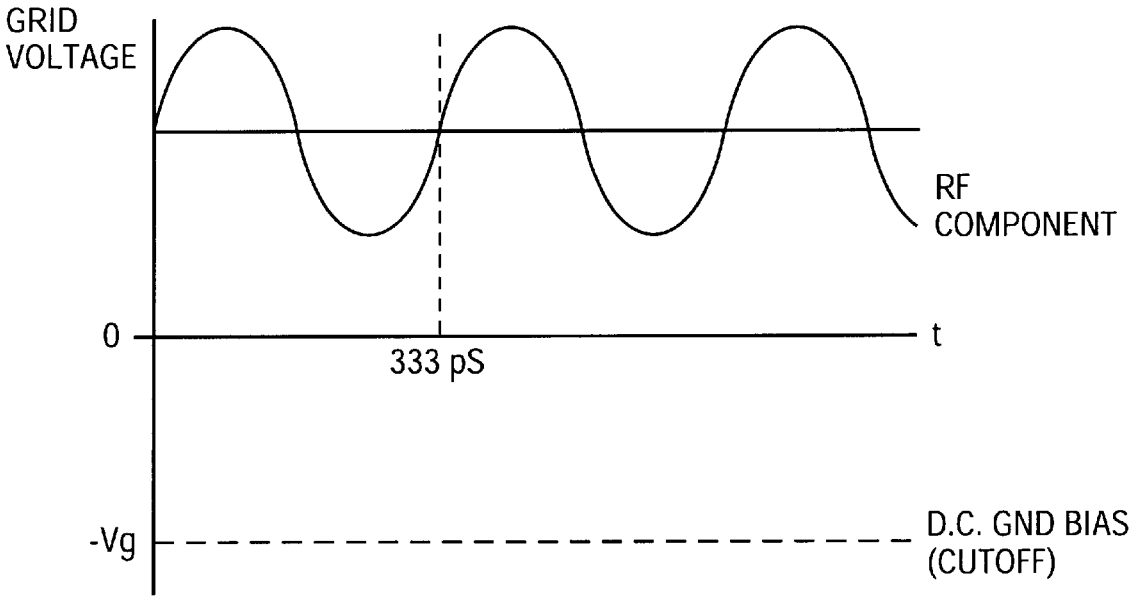
FIG. 3 is a graph depicting the relationship between the RF signal applied to the grid and the grid bias voltage.

FIG. 3 is a graph depicting the relationship between the RF signal applied to grid 16 and the grid source voltage generated by grid bias 26. The period of the signal shown in FIG. 3 is approximately 333 pS. As shown, the grid cutoff voltage (described above in the example as being −30V) is less than the average voltage of the RF signal. In order to generate individual "bunches" of electrons in phase with the RF signal input into accelerator 20, the RF power provided to grid 16 from variable attenuator must be greater than the voltage swing of the grid from −Vg (the point at which the grid is turned off) to +Vg (the point at which the grid is fully turned on).

Figure 4:
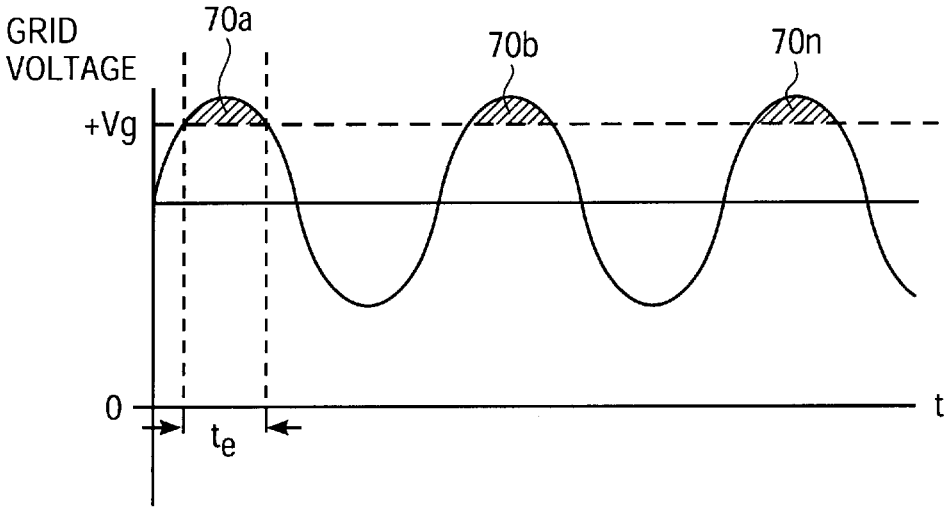
FIG. 4 is a graph depicting the resulting output beam emitted from the electron gun of FIG. 2.

This is shown in FIG. 4, where variable attenuator 28 has been manipulated to provide a RF signal having sufficient power to generate individual electron bunches 70*a–n* of a selected duration. In the depicted example, the RF signal provided from grid RF device 38 has been attenuated to generate individual electron bunches 70*a–n* having a width of $t_e$ (in the example, the width $t_e$=approximately 33 pS). Applicant has found that an electron bunch width of approximately 10% of the wave period is suitable for use with many linear accelerators. Other electron bunch widths may be selected and manipulated using features of embodiments of the present invention. In particular, these widths may be manipulated by selectively attenuating the input RF power using attenuator 28. Further, the phase of the beam emitted may be selectively adjusted relative to the phase of the beam provided to accelerator 20 via waveguide 36 by operating variable phase shifter 30.

The result is an improved electron gun suitable for a variety of applications. No separate "pre-buncher" or input cavity is required to generate electron bunches. Embodiments of the present invention permit adjustment of the phase of the electron bunches introduced to the accelerator, ensuring accurate matching of the phase with the phase of the RF signal directed from the RF source into the accelerator. Manipulation of variable attenuator 28 allows the production of appropriately sized (typically narrow) bunches of input electrons. The result is an improved output signal from accelerator 20 having an improved spectrum. Further, electron guns implemented using features of the present invention substantially eliminate back bombardment and other inefficiencies resulting from the use of separate pre-bunchers or input cavities, while enjoying improved capture efficiencies and overall system performance over a wide range of energies. Further still, electron guns implemented using techniques of the present invention can be added to existing systems with minor modifications.

Those skilled in the art will appreciate that various adaptations and modifications of the just-described preferred embodiments can be configured without departing from the scope and spirit of the invention. For example, although guide electrodes are not shown in the device of FIG. 2, those skilled in the art will recognize that a number of different guide electrodes can be used to assist in the focusing and delivery of electrons to accelerator 20. Further, a number of different anode 14 shapes and configurations may be utilized as known to those skilled in the art to achieve a focused beam of a desired shape and concentration. Therefore, it is to be understood that, within the scope of the appended claims, the invention may be practiced other than as specifically described herein.

What is claimed is:

1. An electron gun, comprising:

a cathode, electrically coupled to operate as a source of charged particles; and a grid, positioned apart from said cathode, said grid and said cathode electrically coupled to a grid voltage source and to a radio frequency (RF) source;

said grid voltage source placing said grid at a first potential; and said radio frequency source placing said grid at a second potential selected to produce groups of said charged particles, said groups produced with each period of a signal received from said RF source.

2. The electron gun of claim 1, further comprising:

an anode, positioned at a greater potential than said cathode, and configured to focus a beam of said groups of charged particles.

3. The electron gun of claim 1, wherein said second potential is selected to produce groups of a first duration.

4. The electron gun of claim 3, wherein said first duration is greater when said second potential is increased.

5. The electron gun of claim 1, further comprising:

a variable attenuator, coupled between said RF source and said grid and said cathode, said variable attenuator operable to attenuate said signal from said RF source.

6. The electron gun of claim 1, further comprising:

a variable phase shifter, coupled between said RF source and said grid and said cathode, said variable phase shifter operable to shift a phase of said signal from said RF source.

7. The electron gun of claim 1, further comprising:

a variable attenuator and a variable phase shifter, coupled between said RF source and said grid and said cathode, said variable attenuator operable to attenuate said signal from said RF source, and said variable phase shifter operable to shift a phase of said signal from said RF source.

8. The electron gun of claim 1, wherein said cathode is a thermionic emission cathode.

9. The electron gun of claim 1, wherein an emitting surface of said cathode is heated by a filament.

10. The electron gun of claim 9, wherein said emitting surface of said cathode is shaped to focus said charged particles towards an aperture of an anode.

11. The electron gun of claim 10, wherein said grid is shaped to conform to said emitting surface of said cathode.

12. A system for providing a focused beam of electrons to an accelerator, comprising:

a cathode, electrically coupled to operate as a source of electrons;

a conductive grid, positioned near an emitting surface of said cathode;

a grid RF source, providing a RF signal to said conductive grid;

a grid voltage source placing said conductive grid at a first potential; and an anode, positioned at a greater potential than said cathode, wherein said RF signal is selected to accelerate groups of said electrons towards said anode, and said anode is configured to focus a beam of said groups of electrons into said accelerator.

13. The system of claim 12, further comprising:

an RF source generating a first RF signal; and a directional coupler receiving said first RF signal and providing said first RF signal to both said grid RF source and to said accelerator.

14. The system of claim 13, wherein said grid RF source attenuates said first RF signal to generate said RF signal provided to said conductive grid.

15. The system of claim 13, wherein said grid RF source phase shifts said first RF signal to generate said RF signal provided to said conductive grid.

16. The system of claim 13, wherein said grid RF source further comprises:

a variable attenuator operable to attenuate said first RF signal; and a variable phase shifter, operable to phase shift said first RF signal, wherein said RF signal provided to said conductive grid is phase shifted and attenuated.

17. The system of claim 16, wherein said RF signal is attenuated to generate said groups of electrons having a selected group duration.

18. The system of claim 16, wherein said RF signal is phase shifted in an amount selected to place said groups of electrons in phase with said first RF signal provided to said accelerator.

19. The system of claim 13, wherein said cathode has an emitting surface heated by a filament.

20. The system of claim 13, wherein said cathode and said conductive grid are selected to have a capacitance of less than 20 pF.

21. A method for generating an electron beam for input into a linear accelerator, comprising:

generating a first RF signal for input into said linear accelerator;

generating a modified RF signal;

causing electrons to be emitted from an emitting surface of a cathode;

applying a D.C. bias to said cathode and to a conductive grid, said conductive grid positioned apart from said emitting surface of said cathode;

applying said modified RF signal to said cathode and to said conductive grid, said modified RF signal selected to accelerate groups of said electrons, each of said groups having a duration; and applying an anode bias to an anode positioned apart from said cathode, said anode bias accelerating said groups of said electrons into said linear accelerator.

22. The method of claim 21, wherein said modified RF signal is phase shifted and attenuated from said first RF signal.

* * * * *